United States Patent [19]

Vorel

[11] Patent Number: 4,615,675

[45] Date of Patent: Oct. 7, 1986

[54] FURNACE CHANNEL HEATING METHOD AND APPARATUS

[75] Inventor: George M. Vorel, Butler, Pa.

[73] Assignee: Thermoject, Inc., Butler, Pa.

[21] Appl. No.: 794,726

[22] Filed: Nov. 4, 1985

[51] Int. Cl.[4] ..... F27D 7/00; F27D 1/16; F24H 1/00; F24J 3/00

[52] U.S. Cl. ..... 432/4; 264/30; 432/9; 432/222; 432/225

[58] Field of Search ..... 432/4, 9, 10, 222, 225; 264/30; 373/162, 163, 164

[56] References Cited

U.S. PATENT DOCUMENTS 1,643,425 9/1927 Summey ..... 264/30

2,655,550 10/1953 Zvanut ..... 266/234

3,439,072 4/1969 Lyman ..... 432/4

4,008,993 2/1977 Severin ..... 432/4

*Primary Examiner*—John J. Camby

*Attorney, Agent, or Firm*—Carothers & Carothers

[57] ABSTRACT

A method and apparatus for improved preheating and/or curing of the channel of an induction furnace wherein an elongated burner tube is provided with a combustion zone adjacent its forwardmost end and an air inlet is provided adjacent its opposite end outside of the furnace to provide high velocity and high volume air flow to cool the burner tube extending within the furnace and support combustion within the burner combustion zone.

14 Claims, 3 Drawing Figures

FURNACE CHANNEL HEATING METHOD AND APPARATUS

BACKGROUND OF THE INVENTION

This invention relates generally to preheating and/or curing of furnace linings, and especially the refractory lining of the channel in an induction furnace. Such a furnace is often used either as a holding furnace to maintain the temperature of a quantity of molten metal such as steel, or as a melting furnace for melting down ore or scrap.

A channel type induction furnace commonly includes a hearth or chamber having walls which are lined with refractory material to withstand the high temperature of the molten metal contained therein. In such a furnace, one or more generally U-shaped pr W-shaped channels communicate in open flow relationship with the furnace chamber to define a circulatory passage from the furnace chamber through the channel and back to the furnace chamber. Intermediate the open ends thereof, the channel is encompassed by electrically conductive media such as copper wire windings to form one or more inductors. When the windings are energized, an inductive field is established which is effective to circulate molten metal through the channel and to inductively heat the molten metal as it passes therethrough. Such circulation and heating of the melt permits precise control of the metal temperature until such time as further processing thereof is undertaken.

Since the introduction of channel type induction furnaces many years ago, practitioners of the art have sought improved means for heating and curing the furnace channel. The refractory material used in a newly replaced channel lining must be properly heat cured before use. Thereafter, with each additional heatup of the furnace the channel lining must be properly preheated to drive out absorbed moisture which could otherwise cause the channel lining to crack or spall upon sudden exposure to the extreme temperature of the molten metal. The extreme abrasion of molten metal flow to which the channel lining is continuously exposed during a furnace campaign also dictates carefully controlled curing of a new channel lining prior to first use and preheating for each subsequent use.

To heat cure a furnace channel, temperatures in the range of 2400° F. to 2500° F. are generally required; however, as the channel usually is only about 1½ to 4 inches in interior diameter and 5 to 6 feet in length, and additionally since the nearest access thereto is commonly at the top of the furnace which is usually at least 4 to 11 feet away from the channel entrance, it has often been impossible to obtain uniform channel temperatures above 2100° F. during channel preheating and/or curing.

There are only two prior approaches to channel heat curing are few. One involves use of an elongated gas pipe burner of 1½ to 2 inches in diameter. The burner pipe is inserted through an access opening in the top or lid of the furnace such that the combustion zone of the burner remains outside of the furnace. This "lazy flame" burner projects the hot combustion products through the length of the burner pipe and toward the furnace channel for heating thereof. Initially, the burner is fired with the highest air volume flow rate that is possible without causing a flameout. The high volume air flow is necessary to help push the hot combustion products through the channel. This is conducive to good heat flow and also helps somewhat to keep the flame temperature low during initial stages of the cure.

Several inherient problems with the use of such burners have been observed. For example, in spite of the high volume air flow, only relative low flame velocity is realistically attainable, a velocity which is insufficient to uniformly distribute the heat of combustion throughout the length of the furnace channel. Additionally, this type of burner has a very poor turndown (i.e. the burner exhibits a low air-to-fuel gas volume ratio and a narrow air to gas volume ratio operating range). As a result, the burner tends to run very hot even at relatively low gas flow rates. The same limitation requires air flow to be reduced as fuel gas flow is increased during progressive heating. Thus, any cooling effect of the air flow on the burner pipe walls is reduced and the remaining burner pipe cooling capacity is more than offset by the heating effect of the furnace atmosphere.

As a result, this burner type is inadequate to the task at both extremes of operation. The initial hot operation has a tendency to thermally shock the channel lining while the inability to efficiently project combustion heat into the channel at higher operating temperatures and to cool the burner pipe often results in premature burner failure and/or inability to generate the desired maximum cure temperature. Burner failure often is manifested as premature slumping as the burner pipe sidewalls become non-self supporting and sag at elevated temperatures of 1800°–2200° F., which is less than the desired maximum cure temperature.

A second known approach to channel preheating or curing utilizes a so-called ejector system in which a venturi device is placed over one end of an elongated aspirator tube externally of the furnace. The opposite end of the tube is placed snugly over the channel entrance and the joint therebetween is sealed. Compressed air supplied to the system is directed across the exterior end of the tube to draw furnace atmosphere through the channel and the tube, and thereby heat the channel. This approach has been unsatisfactory in that the material use to seal the aspiratory tube at the channel entrance may be dislodged when the tube is removed, and the sealing material may fall into the channel and form a blockage. Additionally, this approach does not benefit from large volume flow of ambient temperature air in the aspirator tube throughout the curing process and the tube thus is quickly heated to destructive temperatures by the furnace atmosphere passing therethrough. Another limitation of this approach is insufficient temperature control at elevated temperatures. Specifically, as the venturi effect is increased, an increased draft is generated in the channel and the aspirator tube. Although reasonably good temperature control is realized by this approach in lower temperature ranges, the known ejector systems generally have been of insufficient capacity to create sufficient flow to hold the channel temperature close to the furnace atmosphere temperature. As a result, channel temperature tends to lag behind furnace chamber temperature.

With either of the above prior approaches, the problem of premature tube failure could of course be solved by fabricating the burner or aspirator tube from specialty materials which will tolerate the high temperatures without failure. However, such tube structures would be vastly more expensive than those fabricated from more common materials, and the service life thereof would have to be extended enormously over the expected life of more conventional materials to realize any true ecomony.

Among the prior art patents known to applicant are the following. U.S. Pat. No. 4,008,993 discloses the preheating of a furnace channel by means of a circulation generating article and is based on the venturi method discussed above. U.S. Pat. No. 2,655,550 teaches a channel furnace for melting metal. One manufacturer of burners for furnace preheating is North American Manufacturing Company.

BRIEF SUMMARY OF THE INVENTION

The present invention provides for a novel and improved method and apparatus for furnace channel heating and/or curing which overcomes the above and other limitations of the prior art. The invention, in a presently preferred embodiment thereof, includes an elongated high velocity, excess air, nozzle mix burner tube which operates according to a novel method of heat curing. The burner is supplied with relatively low pressure ambient air from the exterior of the furnace for combustion thereof with fuel gas at the burner nozzle adjacent to the channel opening. The relatively high volume ambient air flow as well as the fuel flow through the burner tube cools the tube and burner, and prevents premature slumping and other modes of heat induced burner failure thereby permitting use of relatively low cost conventional materials to fabricate the tube and burner.

The passage of combustion air through small openings at the burner nozzle increases the air flow velocity substantially, and the combustion of the gas and air at the burner nozzle can produce temperatures up to approximately 3000° F., which exceeds the maximum temperature required for heat curing. Thus high velocity, high temperature combustion products are directed from the burner nozzle into the channel entrance and the flow momentum thereof effectively distributes the heat throughout the length of the channel to assure uniform heating. Additionally, the burner has high turndown capability due to the specific design of the burner nozzle, and this enables the operator to more precisely control incremental channel temperature increases throughout the curing or preheating process.

It is, therefore, one general object of the invention to provide a novel and improved method and apparatus for heating a furnace channel.

A more specific object of the invention is to provide a novel method and apparatus for heating a furnace channel by combustion of a fuel and air mixture directly adjacent to one opening of the furnace channel.

Another object of the invention is to provide a novel burner structure for furnace channel preheating and heat curing.

These and other objects as well as further advantages of the invention will be more fully understood upon consideration of the following detailed description and the accompanying drawings, in which.

Figure 1:
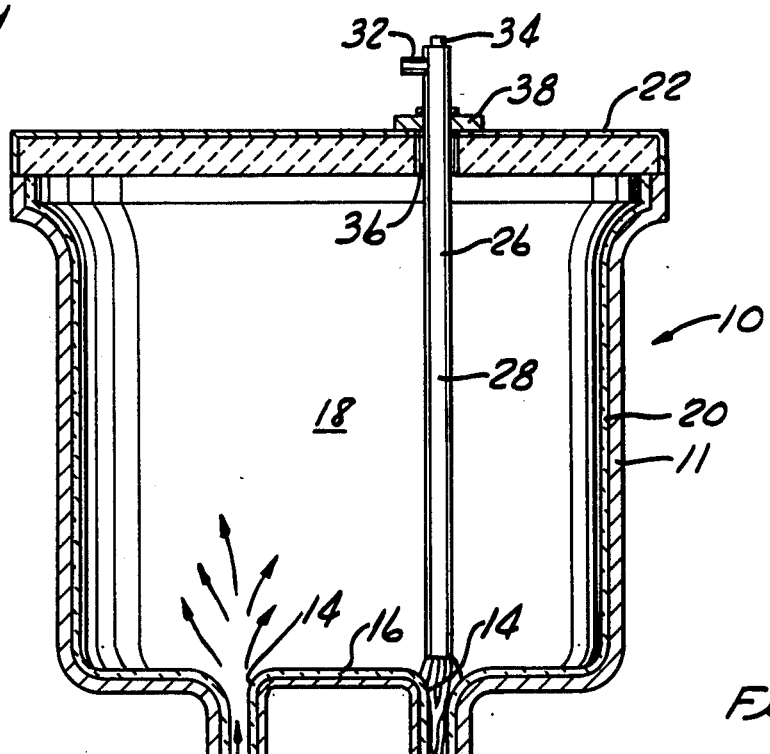
FIG. 1 is a sectional side elevation of an induction furnace including a burner of the present invention and operable in accordance with the method thereof.

One presently preferred embodiment of the invention is shown, by way of example, in FIG. 1 where there is generally indicated at 10 an induction furnace having a chamber 11 and an open ended, generally U-shaped induction channel 12 which communicates adjacent its open ends 14 with the interior space 18 defined within chamber 11. Channel 12 preferably is located subjacent the bottom wall 16 of chamber 18 as shown. Both the chamber 11 and the channel 12 are lined with replaceable refractory material 20 to withstand the elevated temperatures of the molten metal to be contained within the furnace.

A suitable closure such as a lid 22 is provided atop furnace 10 to form a closure for chamber 18. An induction coil 24 encompasses channel 12 and is provided with any suitable and well known electrical energy supply apparatus (not shown) to energize the induction coil 24 and thereby impose an electromagnetic field within channel 12. The field provides generally unidirectional force lines running parallel to the axis of channel 12 within the region of channel 12 adjacent to induction coil 24, thus magnetically moving the molten metal, for example, steel unidirectionally through the channel. Additionally, the energized induction coil is effective to inductively heat the molten metal passing through channel 12. Thus, a circulatory path is established for continuous circulation and heating of molten metal within a heating zone of channel 12. This permits the furnace 10 to be used for many conventional purposes including melting of ore or scrap, or holding a quantity of molten metal at a uniform elevated temperature to await further processing.

It will be further appreciated that the invention may be utilized in cojunction with a wide variety of furnace designs including but not limited to those utilizaed especially for processing of copper or bronze alloys. The above description is merely exemplary of such a furnace. Therefore, as the above description pertains to well known structural features and operational capabilities of an induction furnace, further detailed description thereof is believed unnecessary for an understanding of the present invention.

Furnace 10 is provided with a burner 26 for use in preheating and heat curing of the refractory lining 20 of channel 12. Burner 26 comprises an elongated burner tube 28 of stainless steel or the like having a burner nozzle assembly 30 adjacent one end thereof and air and fuel gas inlets 32, 34 respectively, adjacent its opposite end. Burner 26 is supported with respect to furnace 10 by having the burner end of tube 28 inserted through a suitable access opening 36 that is formed in lid 22, preferably directly above one open end 14 of channel 12. Burner tube 28 thus is positioned within furnace chamber 18 with the burner nozzle assembly 30 thereof adjacent an open end 14 of channel 12. A collar 38 or other suitable suspension device such as a cable and pulley ring or a "come-along" device, for example, retains burner tube 28 in the position described such that a burner flame emitted from the lower or burner end of tube 28 is projected into and through channel 12.

The upper end of burner 26 comprises an upper end portion 40 of tube 28 preferably having a cap 42 which sealingly closes the end of tube 28 and supports a fuel gas supply conduit 44 therein centrally of the tube 28. The outer end of gas supply conduit 44 projects outwardly of cap 42 to form the inlet 35 and is provided with threads 46 or other suitable means for connection to a source of fuel gas flow 48. A transversely disposed conduit 50 penetrates the cylindrical wall of tube 28 adjacent upper end 40 and projects outwardly thereof to form air inlet 32. Conduit 50 is formed to be connected to a suitable supply of combustion air 52 via, for example, a flexible hose (not shown) suitably connected to conduit 50. Thus, as will be seen, fuel gas flow passes within conduit 44 along the length of tube 28 to burner nozzle assembly 30 while combustion air passes thereto within an annular space 54 which surrounds conduit 44.

Figure 2:
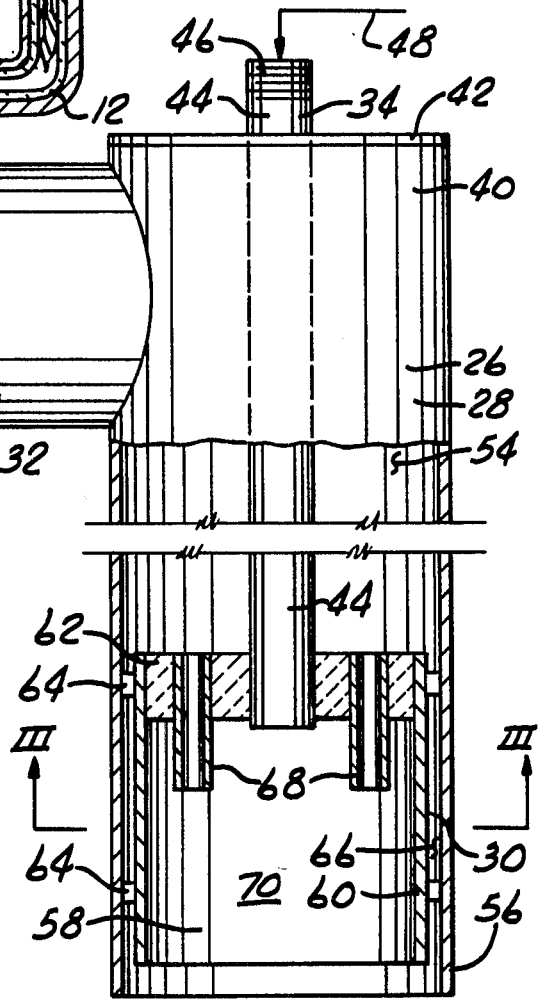
FIG. 2 is a fragmentary, partially sectioned side elevation of the burner shown in FIG. 1.
Figure 3:
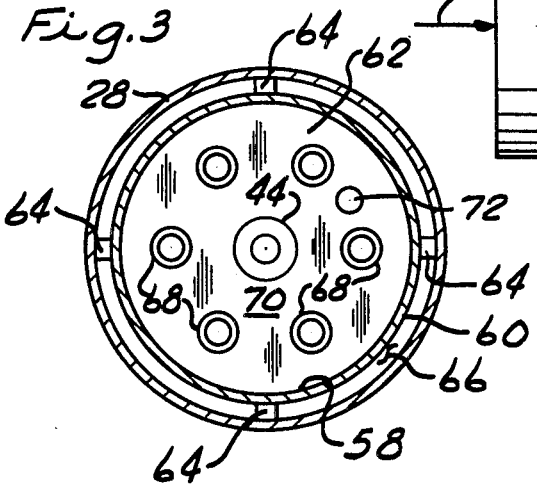
FIG. 3 is a transverse section taken on line 3—3 of FIG. 2.

Burner nozzle assembly 30 (FIGS. 2 and 3) comprises a lower open end portion 56 of tube 28 which receives coaxially therein a cylindrical cooling can 58 comprised of a cylindrical skirt 60 having its upper or inner end closed by a burner plate 62. Cooling can 58 is coaxially retained within end portion 56 of tube 28 as by a plurality of circumferentially spaced bridges 64 located within an annular space 66 defined intermediate skirt 60 and tube end 56. Bridges 64 are of sufficiently limited circumferential extent to leave the major part of space 66 open to longitudinal air flow therethrough. Skirt 60 extends to within ½ to 2 inches of the open end 56 of tube 28.

A plurality of open ended air tubes 68, preferably six tubes, penetrate burner plate 62 and extend into space 70 within cooling can 58. Similarly, the fuel gas conduit 44 also penetrates burner plate 62 centrally thereof. Preferably, conduit 44 is located coaxially of burner plate 62 while air tubes 68 are distributed circumferentially about conduit 44. There preferably is also provided within cooling can 58 spark ignitor 72 (FIG. 3) or other suitable burner ignition device.

Due to the small diameter of the furnace channel and its proportionally long extent, burner 26 is of a design offering small diameter, for example, 4 inches or less, with chracteristics of high velocity combustion, excess air, and nozzle mixing. By use of a nozzle mix burner wherein combustion takes place at the forward end of the burner tube, the fuel and air flow through the burner tube serves to keep the long (4 feet to 11 feet or longer, for example) stainless steel burner tube cool. Of course, upon combustion, the combustion products generate very high temperatures in the range of 3000° F., for example.

It is noted that the burner tube described may have a length to internal diameter ratio of approximately 15:1 to 40:1, although in fact, it is believed the range of usable ratios may be much wider, for example 4:1 to 120:1.

The pronounced elongation of the overall burner tube, in comparison to its internal diameter, appears to have a distinctly beneficial impact upon the ability to inject the burner combustion products into and through the furnace channel; however, the precise mechanism of burner operation which imparts the beneficial result is not understood.

In operation, natural gas or propane is fed through a flexible hose to conduit 44 at the rear end of the burner. Gas supply pressures in the range of 0 to 4 inches water column are believed sufficient. Conduit 44 carries the gas to the burner assembly 30 where it is mixed with combustion air. Air at a pressure of 0 to 12 ounces per square inch, for example, is supplied through the conduit 50 via a flexible hose (not shown). As the air travels within space 54 toward the combustion zone 70 of the burner assembly 30, it washes across the inner walls of tube 28 to cool the tube walls. At the burner plate the air flow is divided and follows one of two paths. Most of the air passes through air tubes 68. As the air flows into space 70 a partial vacuum is created adjacent the foward ends of tubes 68. Simultaneously, gas is discharged into space 70 from the end of conduit 44. A significant portion of the gas fills the partial vacuum adjacent thereto and mixes with the air for combustion. The resultant flames ring the air tube ends and form the base or root flames for that portion of the gas which continues to flow from conduit 44 along the burner axis.

Combustion in this burner takes place in approximately the last 7 inches towards the discharge end and the high velocity combustion products are directed into the channel end 14 where their high momentum effectively distributes the heat throughout the channel 12. The burner's high turn down enables it to deliver closely controlled temperatures and small incremental temperature changes in the channel from ambient to at least 2500° F.

That portion of the air flow which does not flow through air tubes 68 passes to the outside perimeter of the burner plate and through annular space 66 to cool the tube end 56 and the can 58, which is being impinged upon by flames.

The above described structure and operation are key elements to the successful use of the burner for the novel method of this invention for at least two reasons. First, the burner has to pass relatively large volumes of air and gas to keep the structure cool in furnace temperatures of 2500° F. and to generate sufficient momentum to uniformly drive the requisite heat through the channel. Second, the burner has to maintain good flame stability throughout the mix range from high air/low gas to high air/high gas mixtures. Since the refractory lining of the channel must be gradually and carefully brought up to cure temperatures, this high turndown characteristic is necessary for practical and efficient cure operations.

With the disclosed burner, the air volume flow rate throughout the cure remains generally fixed, its level dependent primarily on the dimensions of the furnace channel and to a lesser extent, on the furnace size. The channel temperature is monitored and is controlled by gradually adjusting the gas flow to the burner.

The exhaust from the opposite end of the channel passes into furnace chamber 11, the line 20 of which generally may also need curing. At this time a second burner may be used to heat up and cure the lining of chamber 11 simultaneously with the curing of the lining of channel 12. On furnaces of less than a give size, 10–15 tons for example, the "splashback" from the channel cure burner may be sufficient to heatup the chamber 11.

In practice, care must be taken to direct the channel burner toward the open channel end 14, but some error of alignment is acceptable since the combustion products envelope, which is 6 to 8 inches in diameter exceeds the maximum 4" diameter of the channel opening 14. For efficiency and effectiveness the burner discharge should also be spaced within approximately a 12" vertical offset from the channel entrance 14.

The above description discloses the method of the present invention as well as structural features of the apparatus. However, for further emphasis of the method, it is noted that when burner 26 is inserted through opening 36 and its lower end positioned adjacent channel opening 14 to direct the combustion products thereinto, the burner tube 28 will be subjected to the temperature of the furnace atmosphere in chamber 11. This often will be a very high temperature, especially toward the end of the cure process, if not immediately upon the burner insertion into the furnace. By using the high turndown, excess air burner with combustion taking place at its forwardmost end adjacent to the channel inlet or opening, the air and fuel gas flowing through the burner tube from the exterior of the furnace will serve to cool the burner tube and thereby forestall burner failure such as premature slumping. The same effect is provided by air passing through space 66 to cool both the burner tube end 56 and the cooling can skirt 60 to forestall premature burner assembly failure.

The combustion zone of the burner is located in proximity to the channel opening 14 and in alignment therewith such that the high velocity combustion products are projected directly and forcefully into the channel to distribute the required curing heat uniformly throughout the channel length. By providing relatively large excess air flow at reduced temperature in a high turndown burner, the temperature of the combustion products in the channel may be precisely varied throughout a wide range of temperatures to provide the requisite control of heating for a suitable curing or preheating process.

According to the description herein this invention provides novel apparatus and method for channel furnace preheating and curing. Notwithstanding the description herein of a particularly present preferred embodiment of the invention, it is to be appreciated that the inventor has contemplated numerous alternative and modified embodiments which would also readily occur to others versed in the art. Accordingly, it is intended that the invention be construed broadly and limited only by the scope of the claims appended hereto.

I claim:

1. A burner for heating the channel of a channel type furnace comprising:

an elongated burner tube;

said tube having an open end and retention means whereby said tube is adapted to be positioned within such a furnace with said open end located adjacent an opening to a furnace channel and with the opposite end thereof extending externally of such furnace;

a fuel supply conduit extending within said tube from said opposite end toward said open end to define therein a fuel flow path and to define an air flow path radially intermediate said conduit and the interior walls of said tube;

means adjacent said opposite end for supplying fuel to said conduit from a source of fuel and for supplying combustion air to said air flow path;

a burner assembly retained within said tube adjacent said open end;

said burner assembly including a burner plate portion oriented transversely of the axis of said tube and a depending skirt extending from said plate toward said open end and disposed in radially spaced relationship with respect to the interior walls of said tube to define the confines of said skirt a combustion space which is open to said open end and to define radially intermediate said tube and said skirt an air flow space which is maintained in open communication with said air flow path and said open end;

air tube means penetrating said burner plate portion and communicating with said air flow path for delivery of combustion air therefrom into said combustion space;

a fuel supply means penetrating said plate and communicating with said conduit for delivery of fuel into said combustion space; and said air flow space being maintained in open communication with said open end of said tube whereby air flows within said air flow path and said air flow space to said open end during burner operation to cool said tube.

2. The burner as claimed in claim 1 wherein said fuel supply means is located coaxially of said burner assembly and said air tube means is a plurality of air tubes spaced circumferentially about said fuel supply means.

3. The burner as claimed in claim 1 wherein said tube is a stainless steel tube.

4. The burner as claimed in claim 1 wherein said conduit extends coaxially within said tube.

5. The burner as claimed in claim 1 wherein said air tube means is a plurality of air tubes.

6. The burner as claimed in claim 5 wherein said air tubes are distributed circumferentially about the longitudinal axis of said tube.

7. The burner as claimed in claim 6 wherein said skirt is longitudinally coextensive with a portion of said tube spaced from said open end.

8. The burner as claimed in claim 7 wherein said skirt is spaced from said open end by a spacing in the range of $\frac{1}{2}$ inch to 2 inches.

9. The burner as claimed in claim 8 wherein the ratio of the interior diameter to the length of said tube is in the range of approximately 1:4 to 1:120.

10. In a furnace having a channel which is maintained in open communication with the main chamber of the furnace to provide a circulatory flow path for molten material contained within the furnace, a method of heating the furnace channel comprising the steps of:

providing fuel and excess combustion air from the exterior of said furnace;

directing said fuel and air along separate elongated flow paths defined within an elongated burner tube through the main chamber of said furnace and to an open end of said channel;

simultaneously with said directing, washing said air over the interior walls of said burner tube to cool said tube;

combining said fuel and a portion of said air adjacent said open end for combustion thereof;

directing products of said combustion and the remainder of said air toward said open end for preheating said channel; and varying the ratio of fuel to air by varying the fuel flow rate in response to progressive heating of said channel to gradually increase the temperature of said products of combustion and thereby bring the channel gradually to a predetermined elevated temperature.

11. The method as claimed in claim 10 wherein said air is directed along an elongated flow path within said burner tube having a length dimension to diametrical dimension ratio in the range of 4:1 to 120:1.

12. The method as claimed in claim 10 wherein said combustion air is directed along an elongated flow path which surrounds said flow path for said fuel.

13. The method as claimed in claim 10 wherein said combustion air is at elevated pressure above atmospheric pressure.

14. The method as claimed in claim 13 wherein said elevated pressure in the range of 1 to 12 ounces per square inch.

* * * * *